US010743741B2

(12) United States Patent
Choi et al.

(10) Patent No.: US 10,743,741 B2
(45) Date of Patent: Aug. 18, 2020

(54) DISHWASHER

(71) Applicant: LG Electronics Inc., Seoul (KR)

(72) Inventors: Kyuhyung Choi, Seoul (KR); Jinhong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/418,541

(22) Filed: May 21, 2019

(65) Prior Publication Data

US 2019/0269295 A1 Sep. 5, 2019

Related U.S. Application Data

(62) Division of application No. 15/216,811, filed on Jul. 22, 2016, now Pat. No. 10,349,811.

(30) Foreign Application Priority Data

Jul. 23, 2015 (KR) ..... 10-2015-0104240
Jul. 23, 2015 (KR) ..... 10-2015-0104242

(51) Int. Cl.
*A47L 15/42* (2006.01)
*A47L 15/23* (2006.01)
(Continued)

(52) U.S. Cl.
CPC ..... *A47L 15/428* (2013.01); *A47L 15/20* (2013.01); *A47L 15/22* (2013.01); *A47L 15/23* (2013.01)

(58) Field of Classification Search
CPC ..... A47L 15/22; A47L 15/428; A47L 15/23; A47L 15/20
See application file for complete search history.

(56) References Cited

U.S. PATENT DOCUMENTS 3,323,529 A 6/1967 Geiger
5,333,631 A 8/1994 Kirkland et al.
(Continued)

FOREIGN PATENT DOCUMENTS

CN 203789884 8/2014
CN 203987928 12/2014
(Continued)

OTHER PUBLICATIONS

Chinese Office Action in Chinese Application No. 201610585647.4, dated Jul. 3, 2018, 13 pages.
(Continued)

*Primary Examiner* — Benjamin L Osterhout
(74) *Attorney, Agent, or Firm* — Fish & Richardson P.C.

(57) ABSTRACT

A dishwasher includes a tub. The dishwasher further includes a spray arm that includes a main arm and an auxiliary arm. The dishwasher further includes a fixed gear part that is connected to the tub, that is configured to rotatably support the main arm, and that includes teeth along an outer circumferential surface of the fixed gear part. The dishwasher further includes a rotating gear part that is connected to the main arm and that is configured to rotate and engage the teeth of the fixed gear part based on rotation of the main arm. The dishwasher further includes a link unit that is connected to the rotating gear part, the main arm, and the auxiliary arm, that is configured to move based on rotation of the rotating gear part, and that is configured to guide reciprocation of the auxiliary arm through the predetermined arc.

12 Claims, 18 Drawing Sheets

(51) Int. Cl.
*A47L 15/20* (2006.01)
*A47L 15/22* (2006.01)

(56) References Cited

U.S. PATENT DOCUMENTS

| | | | |
|---|---|---|---|
| 5,579,789 | A | 12/1996 | Spiegel |
| 2010/0043826 | A1 | 2/2010 | Bertsch |
| 2011/0146734 | A1 | 6/2011 | Rappette |
| 2012/0279536 | A1 | 11/2012 | Adams |
| 2013/0074891 | A1 | 3/2013 | Bertsch |
| 2014/0069462 | A1 | 3/2014 | Becker |
| 2014/0190534 | A1 | 7/2014 | Boyer |
| 2014/0216507 | A1 | 8/2014 | Pyo |
| 2015/0000708 | A1 | 1/2015 | Welch |
| 2015/0013729 | A1 | 1/2015 | Feddema |
| 2015/0359408 | A1 | 12/2015 | Boyer |
| 2016/0198927 | A1 | 7/2016 | Boyer |
| 2016/0198928 | A1 | 7/2016 | Xu |

FOREIGN PATENT DOCUMENTS

| | | |
|---|---|---|
| CN | 104739346 | 7/2015 |
| CN | 104783747 | 7/2015 |
| CN | 104783749 | 7/2015 |
| EP | 0068974 | 1/1983 |
| EP | 1050263 | 11/2000 |
| KR | 1020120134370 | 12/2012 |
| KR | 1020130110867 | 10/2013 |
| WO | 2016126086 | 8/2016 |
| WO | 2016126104 | 8/2016 |

OTHER PUBLICATIONS

Extended European Search Report issued in European Application No. 16180686.4 dated Nov. 29, 2016, 8 pages.
Russian Notice of Allowance in Russian Application No. 2017121295, dated Aug. 30, 2018, 19 pages.

DISHWASHER

This application is a divisional of U.S. application Ser. No. 15/216,811, filed on Jul. 22, 2016, now allowed, which claims the benefit of Korean Patent Applications No. 10-2015-0104240, filed on Jul. 23, 2015, and No. 10-2015-0104242, filed on Jul. 23, 2015. The disclosures of the prior applications are incorporated by reference in their entirety.

FIELD

The present application relates to a dishwasher.

BACKGROUND

In general, a dishwasher is an appliance that washes dishes, cookware, etc. (hereinafter referred to as an "object to be washed") by removing foreign substances such as food waste from an object to be washed using a detergent and wash water.

Typically, a dishwasher includes a tub defining a washing compartment, a dish rack provided in the tub, in which an object to be washed is accommodated, a spray arm for spraying wash water to the dish rack, a sump for retaining wash water, and a supply passage, through which the wash water retained in the sump is supplied to the spray arm.

Recently, a dishwasher capable of spraying wash water evenly toward an object to be washed through rotation of the spray arm has been developed. Further, in order to improve washing performance, the spray arm is structured such that a portion thereof performs a reciprocating movement (rolling) along a predetermined circular arc path using the rotating force of the spray arm.

SUMMARY

According to an innovative aspect of the subject matter described in this application, a dishwasher includes a tub that defines a compartment that is configured to receive an object; a spray arm that includes: a main arm that is configured to rotate, that is located in the tub, and that is configured to spray wash water toward the object, and an auxiliary arm that is coupled to the main arm, that is configured to reciprocate through a predetermined arc, and that is configured to spray wash water toward the object; a fixed gear part that is connected to the tub, that is configured to rotatably support the main arm, and that includes teeth along an outer circumferential surface of the fixed gear part; a rotating gear part that is connected to the main arm and that is configured to rotate and engage the teeth of the fixed gear part based on rotation of the main arm; a link unit that is connected to the rotating gear part, the main arm, and the auxiliary arm, that is configured to move based on rotation of the rotating gear part, and that is configured to guide reciprocation of the auxiliary arm through the predetermined arc; and a foreign substance blocking part that is configured to receive the fixed gear part and the rotating gear part and that is configured to block the fixed gear part and the rotating gear part from being exposed to wash water.

This and other implementations may include one or more of the following optional features. The link unit includes a ring-shaped rim portion that is configured to receive the fixed gear part; and a plurality of connection portions that each extend from the rim portion in a radial direction and that are each connected to the spray arm. The link unit defines a recessed portion in one of the connection portions, the recessed portion being configured to receive the rotating gear part and prevent interference by the rotating gear part. The foreign substance blocking part includes a first rib that protrudes from an outer circumferential surface of the rim portion and that is configured to receive the fixed gear part, and a second rib that protrudes from the recessed portion and that is configured to receive the rotating gear part. The foreign substance blocking part includes one or more protruding ribs that each protrude toward the fixed gear part from branched portions of the main arm and the auxiliary arm and that are configured to receive the fixed gear part and the rotating gear part. The one or more protruding ribs each protrude perpendicular to a bottom surface of the main arm and a bottom surface of the auxiliary arm. The one or more protruding ribs are inclined at a predetermined acute angle relative to a bottom surface of the main arm and a bottom surface of the auxiliary arm. The one or more protruding ribs have a predetermined curvature. The foreign substance blocking part includes spray arm ribs (i) that are located in a plane that is defined by the main arm and the auxiliary arm and (ii) that are located at branched portions of the main arm and the auxiliary arm. The ribs include a mesh material.

According to an innovative aspect of the subject matter described in this application a dishwasher includes a tub that defines a compartment that is configured to receive an object; a spray arm that includes a main arm that is configured to rotate, that is located in the tub, and that is configured to spray wash water toward the object, and an auxiliary arm that is coupled to the main arm, that is configured to reciprocate through a predetermined arc, and that is configured to spray wash water toward the object; a fixed gear part that is connected to the tub, that is configured to rotatably support the main arm, and that includes teeth along an outer circumferential surface of the fixed gear part; a rotating gear part that is connected to the main arm and that is configured to rotate and engage the teeth of the fixed gear part based on rotation of the main arm; a link unit that is connected to the rotating gear part, the main arm, and the auxiliary arm, that is configured to move based on rotation of the rotating gear part, and that is configured to guide reciprocation of the auxiliary arm through the predetermined arc, where the spray arm further includes a nozzle that defines a spray hole and is configured to spray wash water toward the fixed gear part and the rotating gear part.

This and other implementations may include one or more of the following optional features. The nozzle is located on a bottom surface of the spray arm and is configured to spray wash water toward at least one of a region where the fixed gear part engages the rotating gear part, an outer circumferential surface of the fixed gear part where the fixed gear part does not engage the rotating gear part, or an outer circumferential surface of the rotating gear part where the fixed gear part does not engage the rotating gear part. The spray arm further includes one or more additional nozzles. The nozzle and the one or more additional nozzles are configured to spray wash water toward a region where the fixed gear part engages the rotating gear part, an outer circumferential surface of the fixed gear part where the fixed gear part does not engage the rotating gear part, and an outer circumferential surface of the rotating gear part where the fixed gear part does not engage the rotating gear part. The nozzle is located on a bottom surface of the auxiliary arm and is configured to spray wash water toward the outer circumferential surface of the rotating gear part, the bottom surface of the auxiliary arm being connected to a portion of the main arm that is connected to rotating gear part.

The nozzle has a plurality of spray holes and is configured to spray wash water toward the region where the fixed gear part engages the rotating gear part, an outer circumferential surface of the fixed gear part where the fixed gear part does not engage the rotating gear part, and an outer circumferential surface of the rotating gear part where the fixed gear part does not engage the rotating gear part. The nozzle is configured to spray wash water at a predetermined spray angle that aligns with a plane that is defined by the rotating gear part while engaged with the fixed gear part. The spray arm defines a supply flow passage that is configured to guide wash water to the object, and a wash flow passage that is configured to guide, to the fixed gear part and the rotating gear part, wash water that is supplied to the supply flow passage. The nozzle is connected to an end portion of the wash flow passage. The link unit includes a ring-shaped rim portion that is configured to receive the fixed gear part; and a plurality of connection portions that each extend from the rim portion in a radial direction and that are each connected to the spray arm. The link unit defines a recessed portion in one of the connection portions, the recessed portion being configured to receive the rotating gear part and prevent interference by the rotating gear part. The link unit further includes an insertion portion that is located in the recessed portion and that guides the rotating gear part into the link unit.

The main arm defines first spray holes that are defined by a portion of the main arm, that extend in a first direction from a center of the spray arm, and that are configured to spray wash water toward the object, and second spray holes that are defined by a portion of the main arm, that extend in a second direction opposite the first direction from the center of the spray arm, and that are configured to spray wash water toward the object. The main arm includes guide protrusions that are located on a bottom surface of the main arm and that are coupled to a first group of the connection portions. The auxiliary arm includes third spray holes that are defined by a portion of the auxiliary arm, that extend in a third direction from the center of the spray arm, and that are configured to spray wash water toward the object, and fourth spray holes that are defined by a portion of the auxiliary arm, that extend in a fourth direction opposite the third direction from the center of the spray arm, and that are configured to spray wash water toward the object. The auxiliary arm includes a force transmission part that is located on a bottom surface of the auxiliary arm and that is coupled a second group of the connection portions that are not included in the first group. An angle defined by the main arm and the auxiliary arm is a right angle or an acute angle. The rim portion is configured to reciprocate between the first spray holes and the second spray holes defined in the main arm based on the rotating gear part revolving along an outer circumferential surface of the fixed gear part. The force transmission part is configured to reciprocate the auxiliary arm by moving in a direction of the rim portion based on the rim portion reciprocating.

An object of the subject matter described in this application lies in a dishwasher, which is capable of preventing foreign substances from adhering to gear parts for rotating a spray arm, thereby ensuring stable rotation of the spray arm.

Another object of the subject matter described in this application lies in a dishwasher, which is capable of rapidly removing adhered foreign substances from gear parts for rotating a spray arm, thereby ensuring stable rotation of the spray arm.

A further object of the subject matter described in this application lies in a dishwasher, which is capable of preventing water leakage from occurring at a spray arm, thereby improving washing efficiency.

Another further object of the subject matter described in this application in a dishwasher, in which an auxiliary arm connection unit is formed integrally with a spray arm, thereby simplifying a manufacturing process.

Still another further object of the subject matter described in this application lies in a dishwasher, in which an auxiliary arm connection unit is formed integrally with a spray arm, thereby preventing water leakage from occurring at a connection portion between the auxiliary arm connection unit and the spray arm.

DETAILED DESCRIPTION

Figure 1:
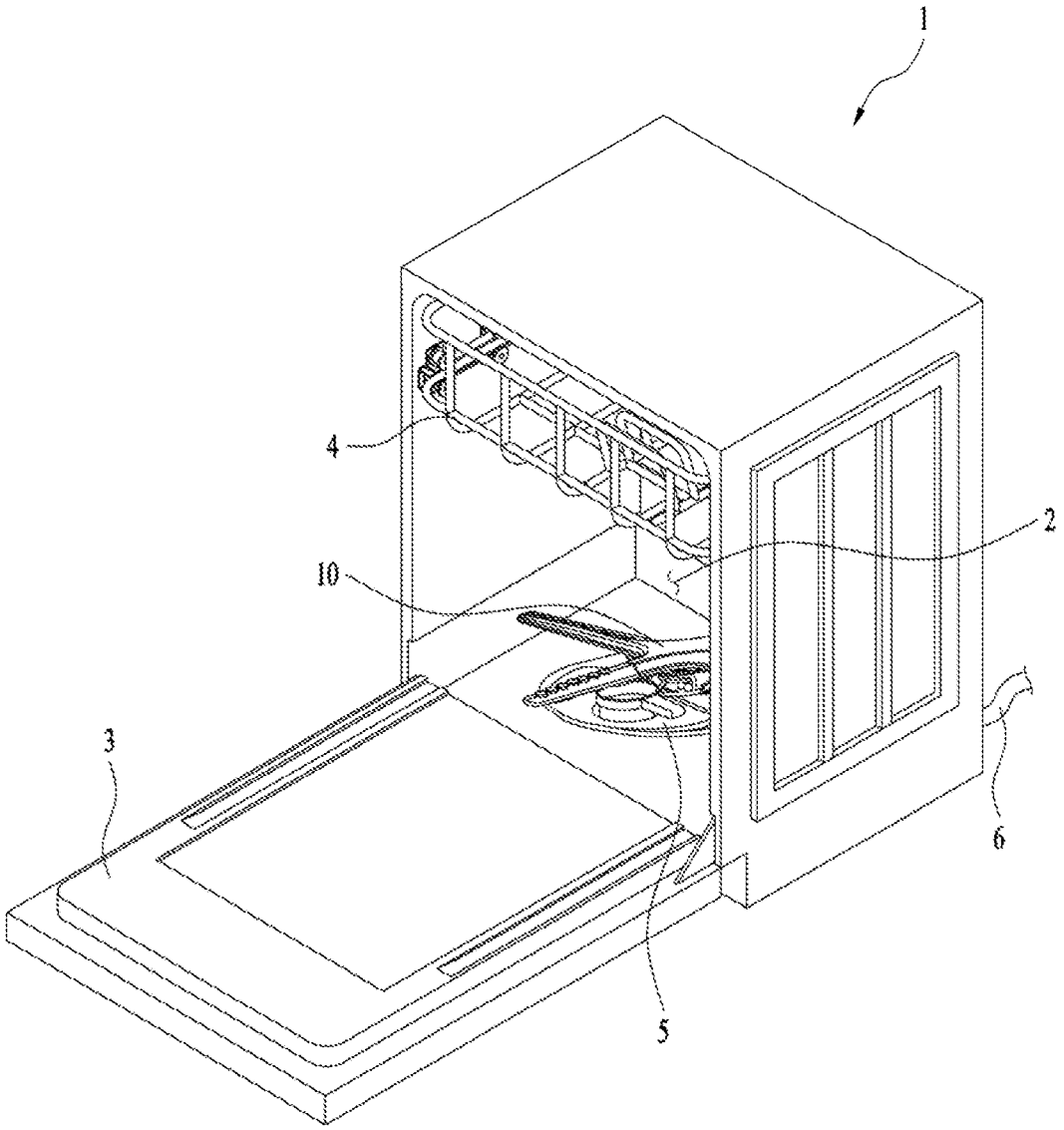
FIG. 1 is a perspective view of an example dishwasher.
Figure 2:
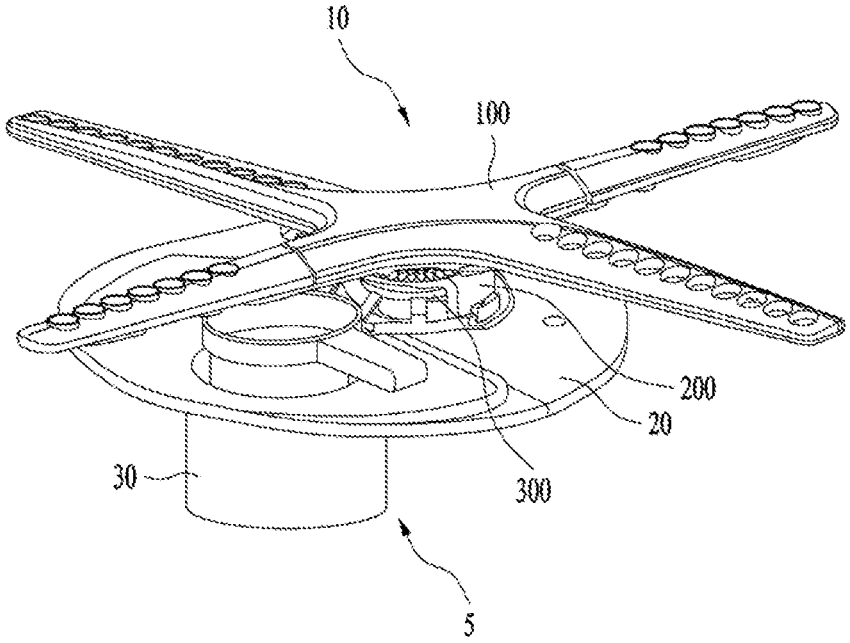
FIG. 2 is a perspective view of an example spray arm assembly.

FIG. 1 illustrates an example dishwasher. FIG. 2 illustrates an example spray arm assembly.

As shown in FIG. 1, a dishwasher 1 may include a tub 2 defining a washing compartment therein, a door 3 for selectively opening and closing the washing compartment, a dish rack 4 provided in the tub 2 so as to accommodate an object to be washed therein, a sump 5 provided in the tub 1 so as to retain wash water therein, and a spray arm assembly 10 provided in the tub 1 so as to spray wash water toward the object to be washed, which is accommodated in the dish rack 4.

The dish rack 4 may be mounted so as to be drawn out forward from the tub 2. Therefore, a user may put an object to be washed in the dish rack 4 after pulling the dish rack 4 out and forward from the tub 2.

As shown in FIG. 2, the dishwasher may include a sump cover 20, which serves as a top surface of the sump 5, and a sump discharge part 30, which is provided at the sump cover 20. The wash water sprayed into the tub 2 may be collected in the sump 5 through the sump discharge part 30. In some implementations, a water supply pump may be provided in the sump 5 to transfer the wash water retained in the sump 5 to the spray arm assembly 10.

The wash water collected in the sump 5 may be supplied again to the spray arm assembly 10 by the water supply pump provided in the sump 5.

The spray arm assembly 10 may be mounted to the sump cover 20, and may function to spray the wash water retained in the sump 5 to the object to be washed accommodated in the dish rack. The spray arm assembly 10 may include a spray arm 100 for spraying wash water, and a fixed gear part 200 and an arm holder 300, which are mounted to the sump cover 20 so as to rotatably support the spray arm 100.

The wash water may flow into the spray arm assembly 10 via the sump 5, and may be then sprayed toward an object to be washed through the spray arm 100.

Unlike the structure illustrated in FIG. 1, the spray arm assembly 10 may not be disposed below the dish rack 4, but may be disposed above the dish rack 4. In some implementations, the spray arm assembly 10 may be provided in a plural number such that the spray arm assemblies 10 spray wash water toward the regions above and below the dish rack 4. The spray arm assembly 10 may be coupled to the sump cover 20.

Hereinafter, the structure of the spray arm assembly 10 will be explained in detail with reference to the attached drawings.

Figure 3:
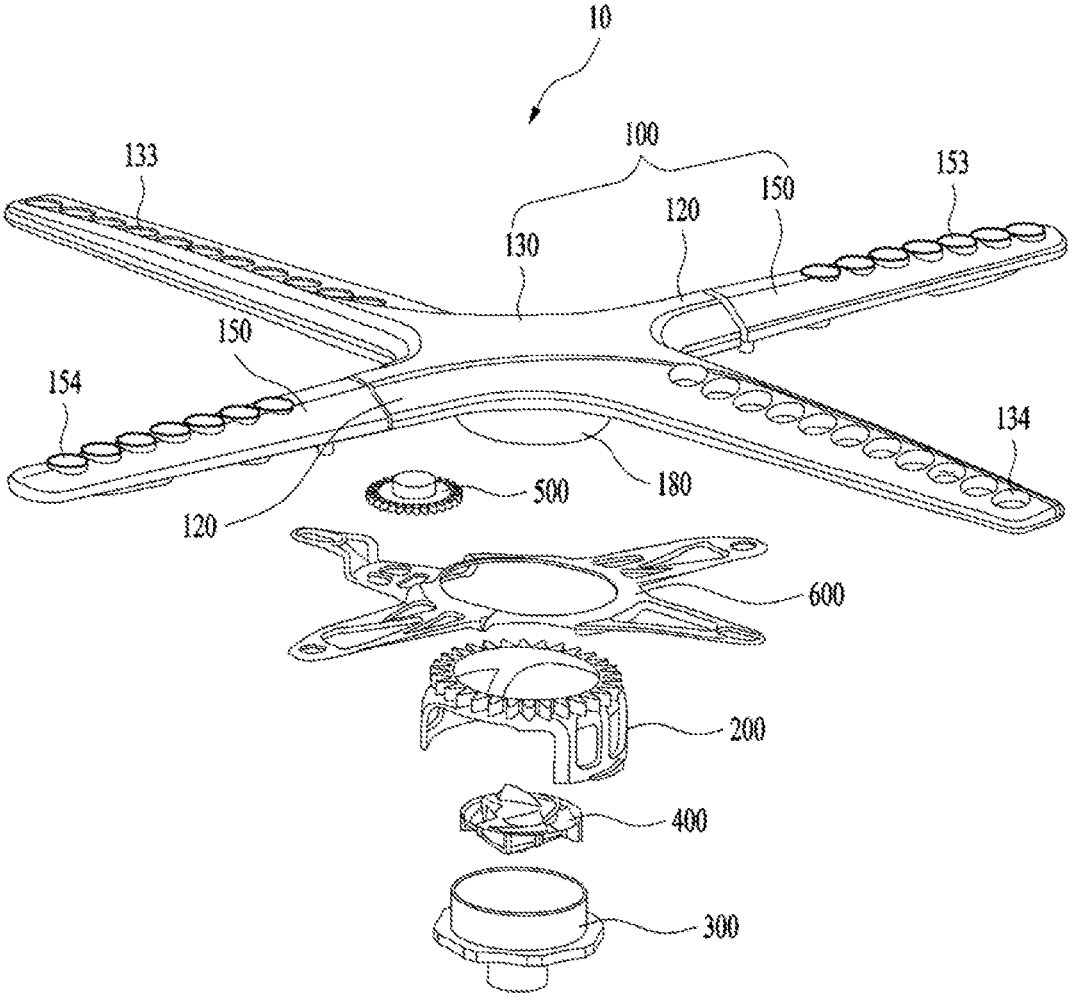
FIG. 3 is an exploded perspective view of an example spray arm assembly.

FIG. 3 illustrates an example spray arm assembly.

Referring to FIG. 3, the spray arm assembly 10 may include a spray arm 100, a fixed gear part 200, an arm holder 300, a flow passage switching part 400, a rotating gear part 500, and a link unit 600.

An arm holder coupling part 180 may be provided on the bottom surface of the spray arm 100, and the arm holder 300, which is coupled to the arm holder coupling part 180, may be provided on the sump cover 20 (refer to FIG. 2). The arm holder 300 may be rotatably coupled to the sump cover 20. That is, the arm holder 300 may be rotated together with the spray arm 100, and may also serve as a rotating shaft of the spray arm 100. Here, the wash water supplied from the sump 5 flows into the arm holder 300, and is then supplied to the spray arm 100.

The flow passage switching part 400 may be accommodated in the arm holder 300. When the water pressure in the arm holder 30 is increased as the wash water flows into the arm holder 300, the flow passage switching part 400 may move upwards, and when the inflow of the wash water into the arm holder 300 is stopped, the water pressure in the arm holder 300 may be decreased, and thus the flow passage switching part 400 may move downwards.

The spray arm 100 may include a main arm 130, on the bottom surface of which the arm holder coupling part 180, which is coupled with the arm holder 300, is disposed, and an auxiliary arm 150, which is rotatably coupled to the main arm 130.

The main arm 130 and the auxiliary arm 150 may be formed with a plurality of flow passages, through which the wash water supplied from the sump 5 flows. The main arm 130 may have spray holes 133 and 134 formed in the top surface thereof, through which the wash water introduced into the main arm 130 is sprayed. The wash water introduced into the main arm 130 from the sump 5 may be sprayed upwards from the main arm 130 through the spray holes 133 and 134.

The spray holes in the main arm 130 may include first spray holes 133, which are formed in a portion of the main arm 130 extending in one direction from the rotational center, positioned to correspond to the fixed gear part 200, so as to spray wash water toward an object to be washed, and second spray holes 134, which are formed in a portion of the main arm 130 extending in the opposite direction from the rotational center, positioned to correspond to the fixed gear part 200, so as to spray wash water toward an object to be washed.

The auxiliary arm 150 may be coupled to the main arm 130 so as to perform a reciprocating movement (rolling) along a predetermined circular arc path. In detail, the main arm 130 may have an extension portion 120 formed to extend in a radial direction, and the auxiliary arm 150 may be coupled to the extension portion 120 so as to perform a reciprocating movement along a predetermined circular arc path.

The auxiliary arm 150 may have auxiliary spray holes 153 and 154 formed so as to spray the wash water introduced into the main arm 130. The auxiliary spray holes in the auxiliary arm 150 may include third spray holes 153, which are formed in a portion of the auxiliary arm 150 extending in one direction from the rotational center, positioned to correspond to the fixed gear part 200, so as to spray wash water toward an object to be washed, and fourth spray holes 154, which are formed in a portion of the auxiliary arm 150 extending in the opposite direction from the rotational center, positioned to correspond to the fixed gear part 200, so as to spray wash water toward an object to be washed.

The main arm 130 and the auxiliary arm 150 may extend radially from the rotational center, positioned to correspond to the fixed gear part 200, and may be angularly spaced apart from each other at a predetermined angle. For example, the portion of the main arm 130, in which the first spray holes 133 are formed, and the portion of the auxiliary arm 150, in which the third spray holes 153 are formed, may be angularly spaced apart from each other at an acute angle or a right angle.

The portion of the main arm 130, in which the first spray holes 133 are formed, and the portion of the auxiliary arm 150, in which the fourth spray holes 154 are formed, may be angularly spaced apart from each other at an obtuse angle or a right angle.

In some implementations, the extension portion 120 may have a transfer flow passage formed therein, through which the wash water supplied from the sump 5 flows. The wash water flowing through the transfer flow passage may be introduced into an auxiliary flow passage formed in the auxiliary arm 150. Therefore, the wash water introduced into the auxiliary flow passage formed in the auxiliary arm 150 may be sprayed through the auxiliary spray holes 153 and 154.

The spray arm 100 may be rotated by a separate driving device. In some implementations, the spray arm 100 may be rotated by the repulsive force that is generated when wash water is sprayed through the spray holes 133 and 134 or the auxiliary spray holes 153 and 154. That is, the spray arm 100 may be rotated by the repulsive force that is generated when wash water is sprayed, without the use of a separate driving device such as a motor or the like.

Figure 4:
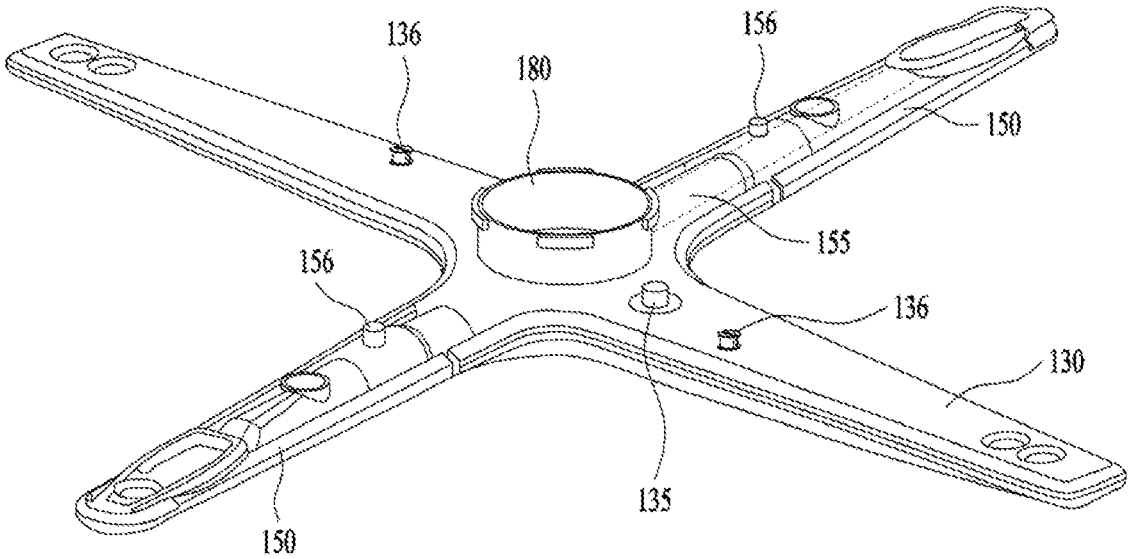
FIG. 4 is a perspective view of a bottom surface of an example spray arm.

FIG. 4 illustrates an example spray arm.

Referring to FIG. 4, the main arm 130 may include a gear-rotating shaft 135, which is inserted into the rotating gear part 500 and serves as the rotating shaft of the rotating gear part 500. The gear-rotating shaft 135 may be formed to protrude from a lower frame of the main arm 130. The gear-rotating shaft 135 may be disposed on the bottom surface of the main arm 130, as illustrated in the drawings, but the position of the gear-rotating shaft 135 is not limited to the bottom surface of the main arm 130.

The main arm 130 may have guide protrusions 136 formed so as to guide the movement of the link unit 600.

The auxiliary arm 150 may have force transmission parts 156 formed so as to receive force from the link unit 600. The force transmission parts 156 may be protrusions, which protrude downwards from the bottom surface of the auxiliary arm 150.

Figure 5:
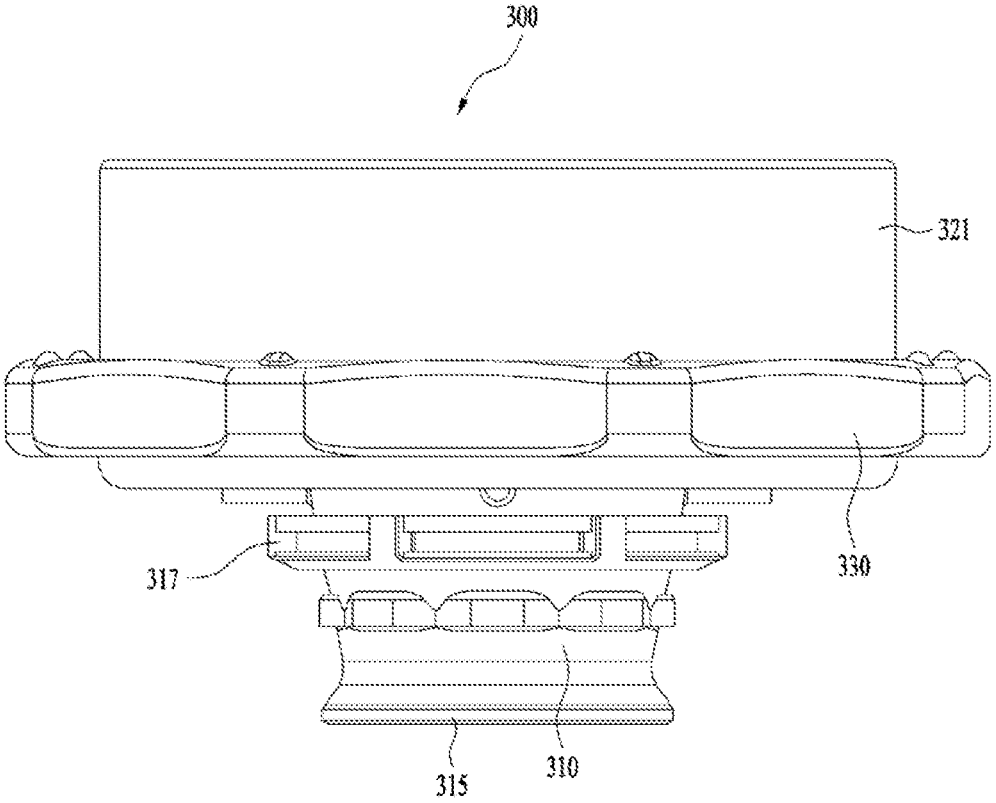
FIG. 5 is a side view of an example arm holder.

FIG. 5 illustrates an example arm holder.

As illustrated in FIG. 5, the arm holder 300 may include an inlet portion 310, through which the wash water retained in the sump 5 is introduced, and a coupling portion 330, which is coupled to the spray arm 100.

The inlet portion 310 may be formed with a hole, through which the wash water retained in the sump 5 is supplied. Therefore, the wash water retained in the sump 5 may flow into the arm holder 300 through the hole formed in the inlet portion 310.

The inlet portion 310 may have a separation-prevention portion 315, formed to prevent the arm holder 300 from being separated from the sump cover 20. The separation-prevention portion 315 may be formed by expanding an end portion of the inlet portion 310. The separation-prevention portion 315 may be connected to the sump cover 20. Accordingly, the inlet portion 310 may be rotatably coupled to the sump cover 20. The arm holder 300 may be received in the arm holder coupling part 180, which is provided on the bottom surface of the spray arm 100 (refer to FIG. 3).

Figure 6:
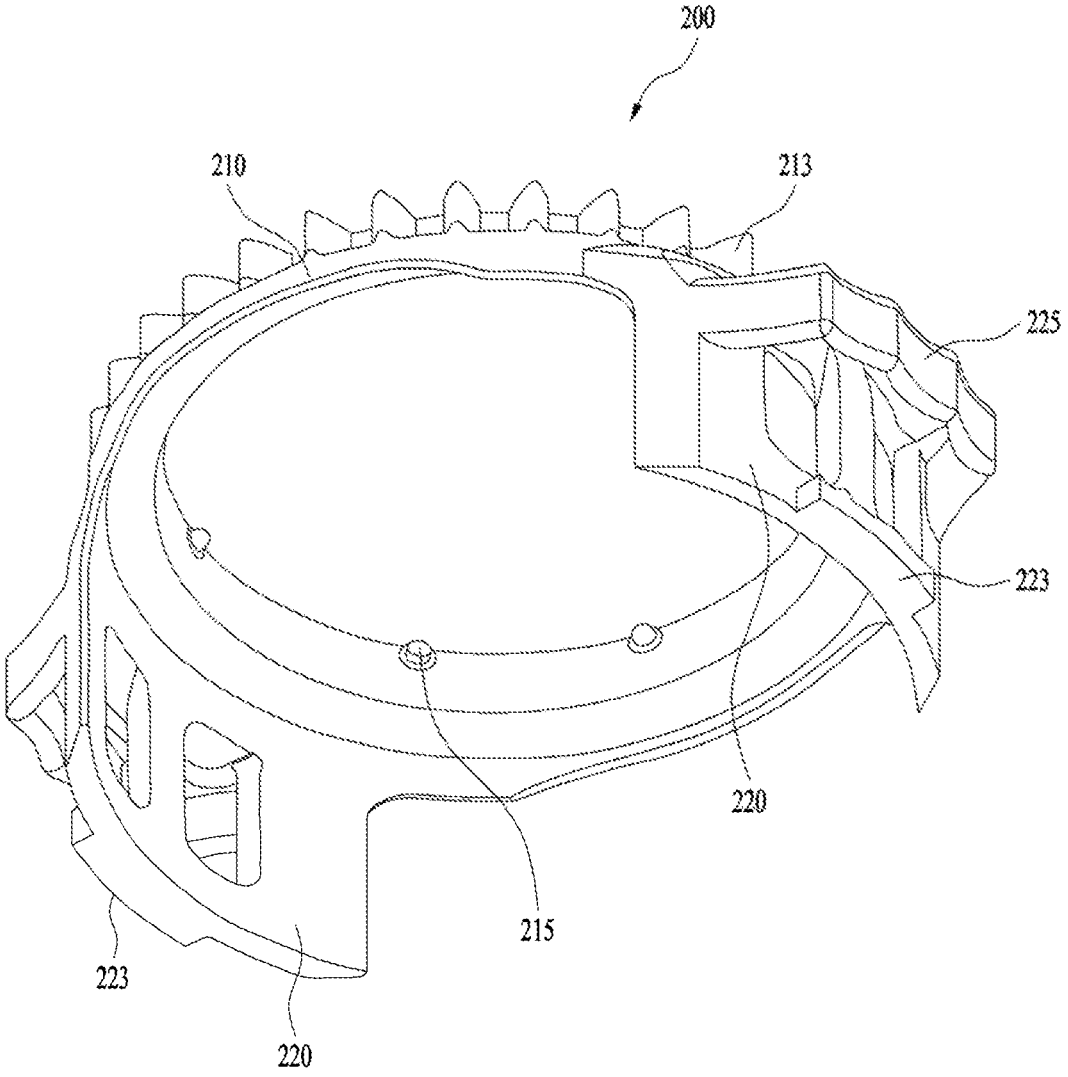
FIG. 6 is a perspective view of a bottom surface of an example fixed gear part.

FIG. 6 illustrates an example fixed gear part.

Referring to FIG. 6, the fixed gear part 200 may be coupled to the sump cover 20 in a manner such that fastening portions 223 provided at the fixed gear part 200 are fastened to the sump cover 20. Unlike the arm holder 300, the fixed gear part 200 may be non-rotatably secured to the arm holder 300.

The fixed gear part 200 may include a rim portion 210, which is provided with a plurality of teeth 213, and support portions 220, which extend downwards from the rim portion 210. The arm holder coupling part 180 may be inserted into the rim portion 210.

The rim portion 210 may have gap-reducing protrusions 215 formed to reduce the gap between the rim portion 210 and the arm holder coupling part 180. The gap-reducing protrusions 215 may be provided in a plural number, and may protrude toward the center of the rim portion 210.

The support portions 220 may be disposed at two opposing positions on the rim portion 210. Each of the support portions 220 may be provided with the fastening portion 223, which is fastened to the sump cover 20. Each of the fastening portions 223 may be a protrusion protruding from the side surface of the corresponding support portion 220. The fixed gear part 200 may be secured to the sump cover 20 via the fastening of the fastening portions 223 to the sump cover 20.

Each of the support portions 220 may be further provided with a knob portion 225, which a user grabs to couple or remove the fixed gear part 200 to/from the sump cover 20. The knob portions 225 may be formed to extend in the radial direction of the fixed gear part 200. Further, each of the knob portions 225 may be formed such that at least a portion of the surface thereof is convex or concave so that a user can grab the knob portions 225.

The rotating gear part 500 may be rotatably mounted to the bottom surface of the spray arm 100, and may be engaged with the fixed gear part 200.

Figure 7:
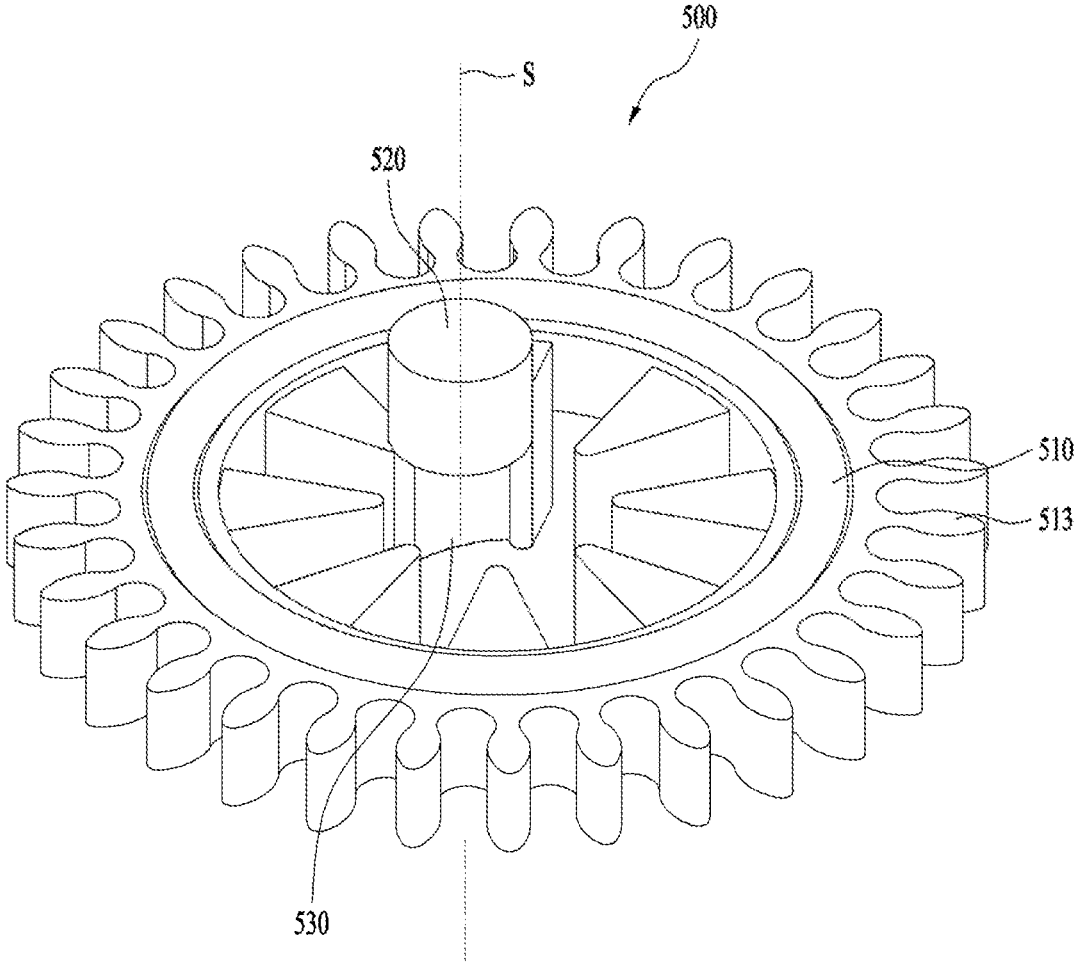
FIG. 7 is a perspective view of a bottom surface of an example rotating gear part.

FIG. 7 illustrates an example rotating gear part.

Referring to FIG. 7, the rotating gear part 500 may include a rim portion 510, which is provided with a plurality of teeth 513 formed along the outer circumferential surface thereof, a rotating shaft insertion portion 530, into which the gear-rotating shaft 135 is inserted, and an eccentric protrusion 520, which is inserted into the link unit 600 so as to make the link unit 600 perform a reciprocating movement. The eccentric protrusion 520 may be disposed eccentrically from the center of the rim portion 510. The gear-rotating shaft 135 may be inserted into the rotating shaft insertion portion 530. The eccentric protrusion 520 may have a recess formed in a portion thereof into which the rotating shaft insertion portion 530 is inserted.

The eccentric protrusion 520 may protrude and extend in the direction of the rotational axis S of the rotating gear part 500. The rotational axis S corresponds to the rotational center of the rotating gear part 500. In some implementations, unlike the structure illustrated in the drawings, the eccentric protrusion 520 may be disposed on the outer circumferential surface of the rim portion 510.

When the spray arm 100 rotates, the rotating gear part 500 may revolve along the circumference of the fixed gear part 200, which is secured to the sump cover 20, and may also rotate in engagement with the fixed gear part 200 at the same time. The rotating gear part 500 may be coupled to the gear-rotating shaft 135, which is provided at the main arm 130, in an insertion manner. Accordingly, the rotating gear part 500 may be coupled to the main arm 100, and may be capable of rotating about the gear-rotating shaft 135.

Figure 8:
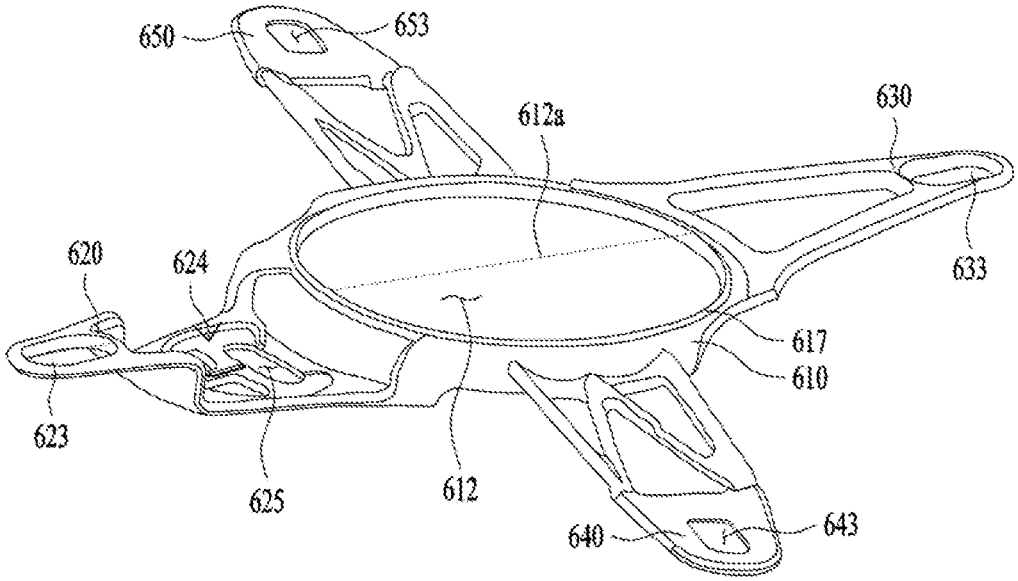
FIG. 8 is a perspective view of an example link unit.
Figure 9A:
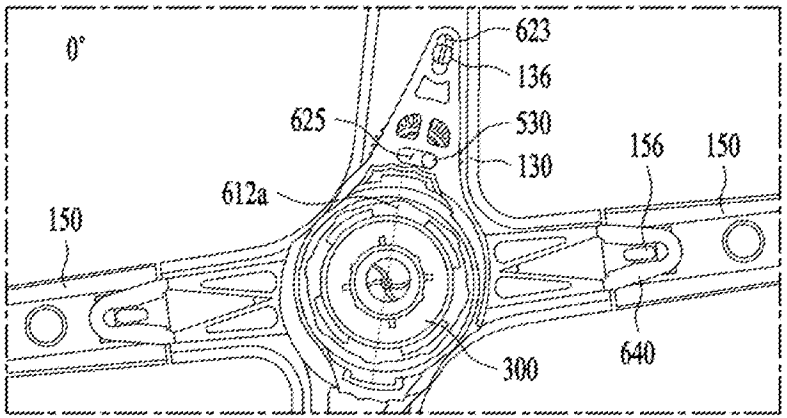
FIGS. 9(*a*)-9(*d*) are a views of an operation of an example auxiliary arm by a link unit.
Figure 9B:
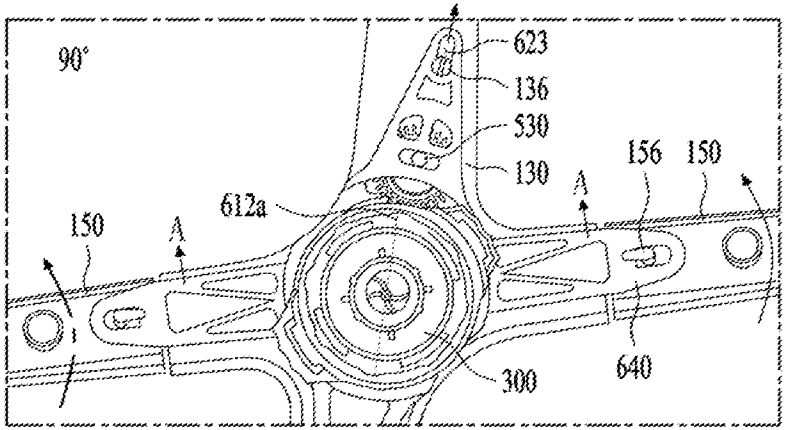
Figure 9C:
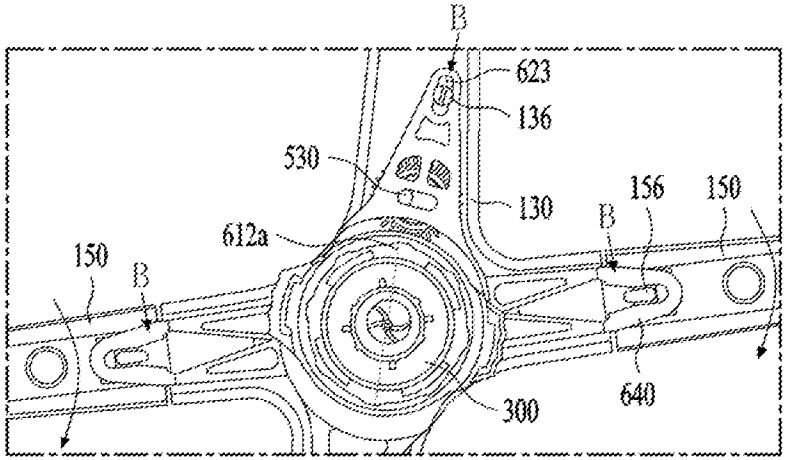
Figure 9D:
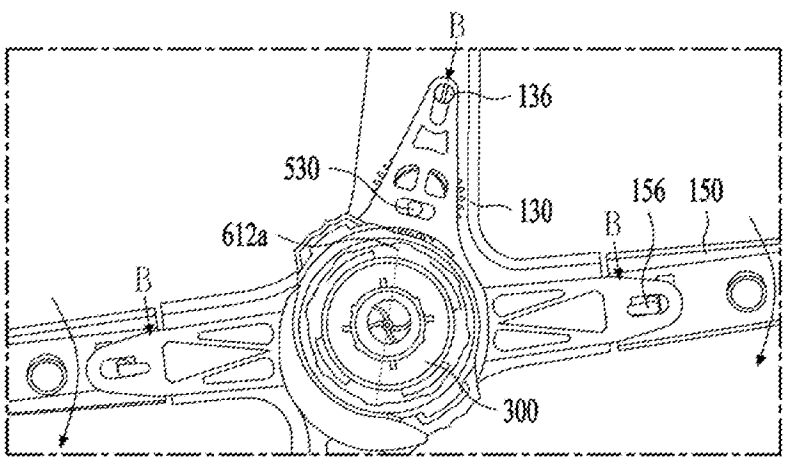

FIG. 8 illustrates an example link unit.

The link unit 600 may be connected to the main arm 130 and the auxiliary arm 150 by the guide protrusions 136 and the force transmission parts 156 (refer to FIG. 4). That is, the link unit 600 may be connected to 4 points of the spray arm 100.

The link unit 600 may include a ring-shaped rim portion 610, and a plurality of extension portions 620, 630, 640 and 650, which extend from the rim portion 610 in the radial direction.

The rim portion 610 may be formed with an insertion hole 612, into which the arm holder coupling part 180 is inserted. The insertion hole 612 may be formed to have an elliptical shape. Therefore, the arm holder coupling part 180 may move in the direction of the long axis 612*a* of the insertion hole 612.

The rim portion 610 may be further provided with a reinforcement rib 617 for increasing the rigidity of the rim portion 610. The reinforcement rib 617 may be formed along the circumferential direction of the rim portion 610, and may protrude upwards.

The first extension portions 620 and 630 may be coupled to the main arm 130, and the second extension portions 640 and 650 may be coupled to the auxiliary arm 150. In detail, the first extension portions 620 and 630 may be provided with guide portions 623 and 633, into which the guide protrusions 136 of the main arm 130 are fitted, and the second extension portions 640 and 650 may be provided with transmission portions 643 and 653, into which the force transmission parts 156 of the auxiliary arm 150 are fitted. Therefore, the movement of the link unit 600 may be transmitted to the auxiliary arm 150 through the force transmission parts 156.

Any one of the extension portions 620, 630, 640 and 650 may be further provided with a recessed portion 624 in order to avoid interference with the rotating gear part 500. The recessed portion 624 may be provided with an insertion portion 625, into which the eccentric protrusion 520 of the rotating gear part 500 is inserted. The insertion portion 625, as illustrated in the drawings, may be formed in an elongated hole shape.

As the link unit 600 transmits the force supplied from the rotating gear part 500 to the force transmission parts 156, the auxiliary arm 150 may perform a reciprocating movement (rolling) along a predetermined circular arc path. That is, the reciprocating movement of the link unit 600 may be converted into the reciprocating movement (rolling) of the auxiliary arm 150 along the circular arc path.

FIGS. 9(*a*)-9(*d*) illustrate an example auxiliary arm by an example link unit.

Referring to FIGS. 9(*a*)-9(*d*), the constitution in which the auxiliary arm 150 is rotated as the link unit 600 is rotated by the rotating gear part 500 will be explained. In some implementations, FIGS. 9(*a*), 9(*b*), 9(*c*), and 9(*d*) are views showing the bottom surface of the spray arm assembly 10 when the rotating gear part 500 rotates 0 degrees, 90 degrees, 180 degrees and 270 degrees, respectively.

Referring to FIG. 9(*a*), when the rotating gear part 500 is in an initial state, i.e., a non-rotated state, the eccentric protrusion 520 is located at one end portion of the insertion portion 625. Referring to FIG. 9(*b*), when the rotating gear part 500 rotates 90 degrees counterclockwise, the link unit 600 is moved in the direction A of the long axis 612*a* of the insertion hole 612 by the eccentric protrusion 520.

That is, since the rim portion 610 is formed in an elliptical shape, the rim portion 610 moves linearly toward the main arm 130 as the rotating gear part 500 revolves around the fixed gear part 200. At this time, since the main arm 130 and the auxiliary arm 150 are angularly spaced apart from each other at a right angle or an acute angle, as the link unit 600 moves in the direction of the long axis 612*a*, the extension portion 640 applies force to the force transmission part 156 in the moving direction of the link unit 600.

Accordingly, the auxiliary arm 150 is moved upwards (in the drawing) along a circular arc path at a predetermined angle. The angle at which the auxiliary arm 150 reciprocates may be about 40 degrees.

Referring to FIG. 9(*c*), when the rotating gear part 500 rotates 90 degrees further counterclockwise, the link unit 600 is moved in the direction B of the long axis 612*a*, which is opposite the direction A.

Accordingly, the link unit 600 returns to the same position as illustrated in FIG. 9(*a*). At the same time, the auxiliary arm 150 returns to its original position while being moved along the circular arc path in the reverse direction by the extension portion 640.

Referring to FIG. 9(*d*), when the rotating gear part 500 rotates 90 degrees further counterclockwise, the link unit 600 is moved in the direction B of the long axis 612*a* by the eccentric protrusion 520.

Since the rim portion 610 is formed in an elliptical shape, the rim portion 610 moves linearly in the reverse direction as the rotating gear part 500 revolves around the fixed gear part 200. At this time, the auxiliary arm 150 is moved along the circular arc path at a predetermined angle.

The angle at which the auxiliary arm 150 reciprocates may be about 40 degrees. In other words, as the rim portion 610 of the link unit 600 reciprocates linearly toward the first spray holes 133 and the second spray holes 134 of the main arm 130, the force transmission part 156 reciprocates linearly through the extension portion 640, thereby making the auxiliary arm 150 perform a reciprocating movement along the circular arc path.

The reciprocating movement of the auxiliary arm 150 along the circular arc path may be considered as vibration movement, and may particularly be considered to correspond to rolling, among the several types of vibrations including rolling, yawing and pitching.

Hereinafter, the structure of preventing the adherence of foreign substances to the spray arm assembly will be explained with reference to FIG. 10.

The spray arm 100 is rotated by the repulsive force that is generated when wash water is sprayed through the spray holes 133, 134, 153 and 154 formed in the main arm 130 and the auxiliary arm 150.

However, the foreign substances removed from an object to be washed may adhere to the teeth 213 of the fixed gear part 200 or the teeth 513 of the rotating gear part 500. In this case, the foreign substances may move to the region of engagement between the fixed gear part 200 and the rotating gear part 500, and may even make it impossible for the rotating gear part 500 to revolve around the fixed gear part 200.

If the foreign substances adhere to the teeth 213 and 513, the spray arm 100 may not be rotated, and thus wash water may be sprayed toward a limited region rather than being sprayed evenly toward an object to be washed. Further, if the rotating gear part 500 does not revolve along the circumference of the fixed gear part 200, the link unit 600 cannot make the auxiliary arm 150 perform a rolling movement. As a result, the washing efficiency of the dishwasher is deteriorated.

In addition, a load due to the torque generated at the spray arm 100 may be applied to the fixed gear part 200 and the rotating gear part 500, which may cause damage to the components.

Therefore, there is a need to prevent foreign substances from adhering to the fixed gear part 200 and the rotating gear part 500 or to remove the adhered foreign substances rapidly.

Figure 10:
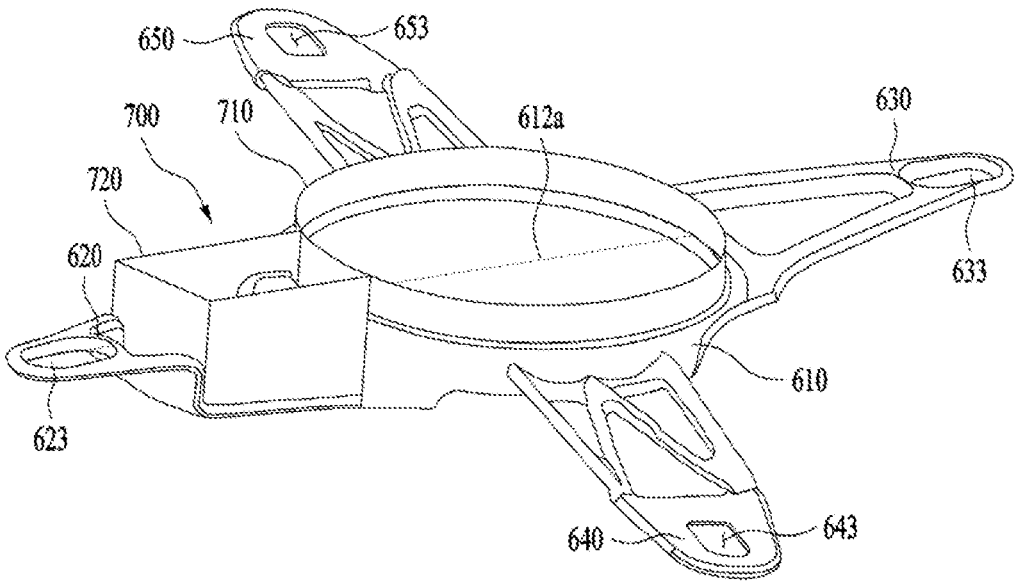
FIG. 10 is a perspective view of a bottom surface of an example link unit having a foreign substance blocking part.

FIG. 10 illustrates an example link unit 600 having an example foreign substance blocking part 700.

The rim portion 610 of the link unit 600 is a portion through which the fixed gear part 200 passes, and the recessed portion 624 is a portion in which the rotating gear part 500 is received. Therefore, the foreign substance blocking part 700 may include a first rib 710, which is formed along the outer circumferential surface of the rim portion 610 so as to surround the outer circumferential surface of the fixed gear part 200, and a second rib 720, which is formed on the recessed portion 624 so as to surround the outer circumferential surface of the rotating gear part 500.

The ribs 710 and 720 function to prevent the fixed gear part 200 and the rotating gear part 500 from being exposed to foreign substances generated during the washing process. Accordingly, the rotating gear part 500 is capable of continually revolving along the circumference of the fixed gear part 200, thereby resolving the aforementioned problems.

Figure 11:
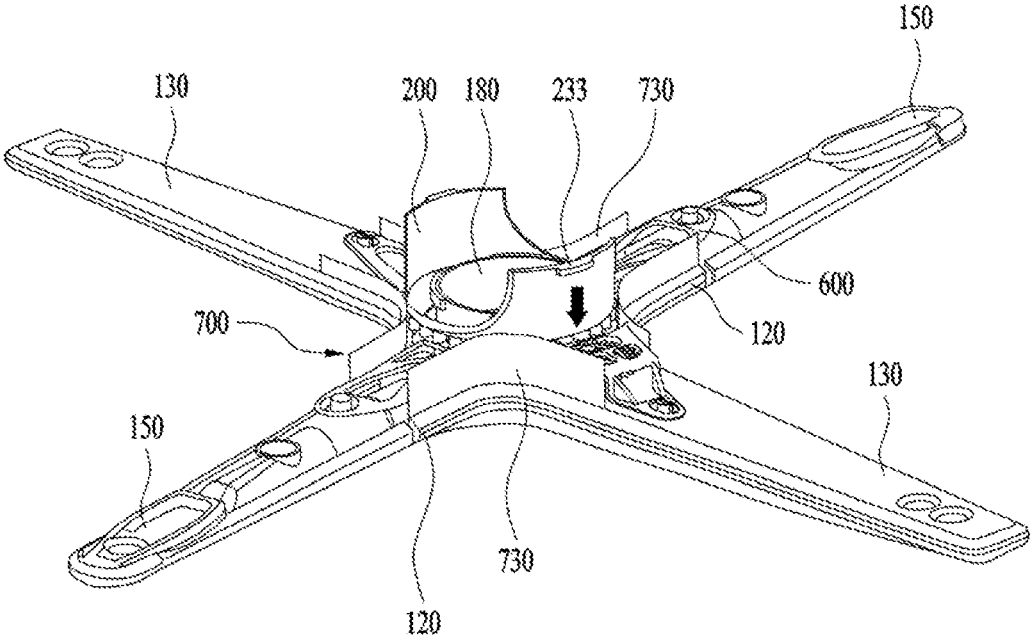
FIG. 11 is a perspective view of a bottom surface of an example spray arm having a foreign substance blocking part.

FIG. 11 illustrates an example spray arm 100 having an example foreign substance blocking part 700.

The foreign substance blocking part 700 may include protruding ribs 730, which protrude in the downward direction of the spray arm 100. The protruding ribs 730 may protrude from one surface of the extension portion 120 toward the sump cover 20, and the distance between the protruding ribs 730 may be equal to the width between the outer peripheral surfaces of the extension portion 120. That is, the protruding ribs 730 may extend radially from the rotational center of the main arm 130.

In addition, since the end portions of the protruding ribs 730 that are directed toward the end of the main arm 130 are spaced apart from each other and the end portions of the protruding ribs 730 that are directed toward the end of the auxiliary arm 150 are spaced apart from each other, interference with the link unit 600 may be avoided.

That is, since the fixed gear part 200 and the rotating gear part 500 are disposed on the bottom surface of the extension portion 120, they may be surrounded by the protruding ribs 730. Therefore, the protruding ribs 730 may prevent foreign substances from adhering to the fixed gear part 200 or to the rotating gear part 500.

In some implementations, first and second ribs 710 and 720 disposed at the link unit and the protruding ribs 730 disposed at the spray arm may be inclined at a predetermined acute angle relative to the vertical plane of the dishwasher, or may be formed with a predetermined curvature. The inclination of the ribs may prevent the fixed gear part 200 and the rotating gear part 500 from being exposed to wash water more effectively than ribs extending in the vertical direction.

The ribs formed with a predetermined curvature may contain the fixed gear part 200 and the rotating gear part 500 more effectively than ribs that extend in the vertical direction or ribs that are inclined at a certain angle, thereby improving space utilization.

Figure 12:
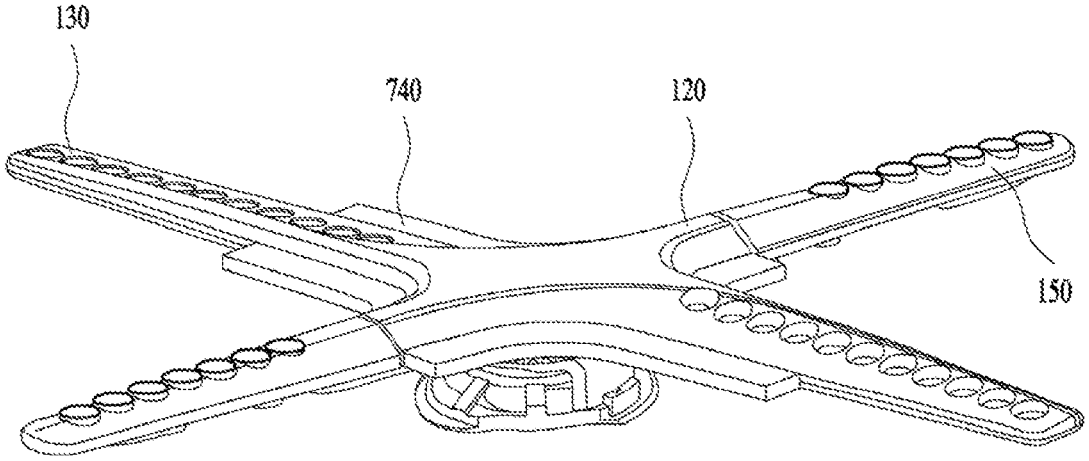
FIG. 12 is a perspective view of an example spray arm having a foreign substance blocking part.

FIG. 12 illustrates an example spray arm having an example foreign substance blocking part.

Referring to FIG. 12, the foreign substance blocking part 700 may include spray arm ribs 740, which lie in substantially the same plane as the main arm 130 and the auxiliary arm 150 and are located at regions at which the auxiliary arm 150 branches from the main arm 130.

That is, the spray arm ribs 740 may have a flange shape that is capable of preventing the wash water falling to the spray arm 100 from directly contacting the fixed gear part 200 or the rotating gear part 500. In some implementations, the ribs 720, 730 and 740 constituting the foreign substance blocking part 700 may be a mesh member.

The mesh-type ribs may prevent foreign substances from approaching the fixed gear part 200 and the rotating gear part 500, but may allow the fixed gear part 200 and the rotating gear part 500 to be exposed to the wash water so as to be washed.

In some implementations, the foreign substance blocking part 700 may have a configuration that is capable of preventing foreign substances from adhering to the fixed gear part 200 and the rotating gear part 500 and of also preventing the fixed gear part 200 and the rotating gear part 500 from being exposed to the wash water so as to prevent corrosion.

Hereinafter, the constitution of removing the adhered foreign substances from the fixed gear part 200 and the rotating gear part 500 will be explained with reference to FIG. 13.

It may be important not only to prevent foreign substances from adhering to the fixed gear part 200 or to the rotating gear part 500, but also to remove such adhered foreign substances rapidly.

Figure 13:
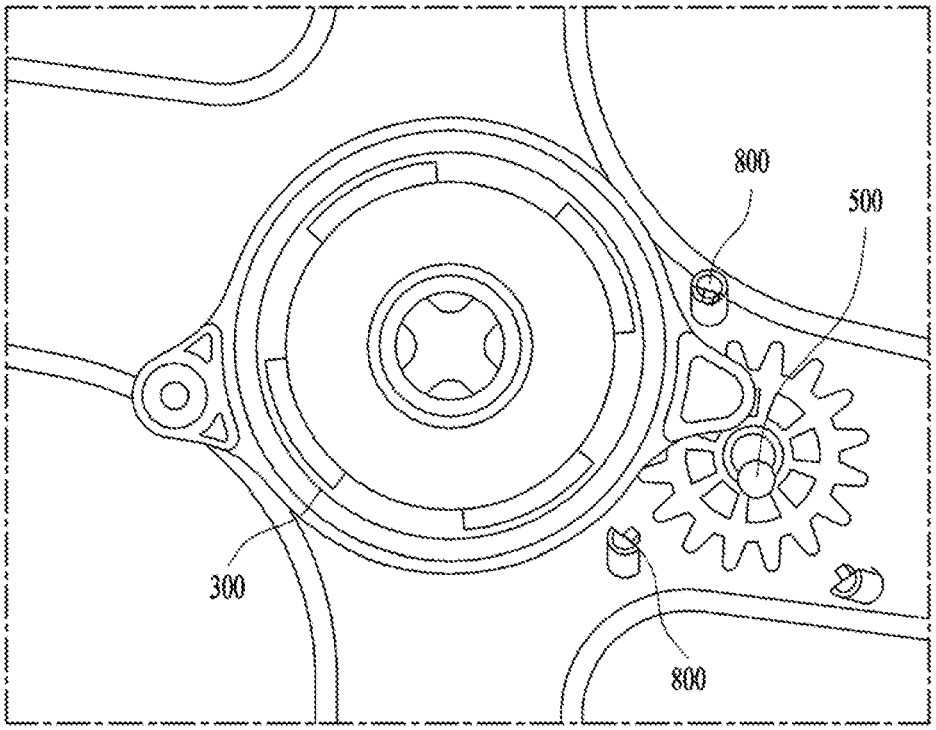
FIG. 13 is an enlarged view showing the bottom surface of the spray arm.

FIG. 13 illustrates an example spray arm, which illustrates a nozzle for removing the adhered foreign substances from the fixed gear part 200 and the rotating gear part 500.

The nozzle 800 may be disposed on the bottom surface of the spray arm 100. The nozzle 800 may spray wash water toward at least any one of the region of engagement between the fixed gear part 200 and the rotating gear part 500, the outer circumferential surface of the fixed gear part 200 in the non-engaged region, and the outer circumferential surface of the rotating gear part 500 in the non-engaged region.

In some implementations, one or more nozzles 800 may be provided in order to spray wash water toward all of the region of engagement between the fixed gear part 200 and the rotating gear part 500, the outer circumferential surface of the fixed gear part 200 in the non-engaged region, and the outer circumferential surface of the rotating gear part 500 in the non-engaged region.

In some implementations, the nozzle 800 may have a plurality of spray holes in order to spray wash water toward all of the region of engagement between the fixed gear part 200 and the rotating gear part 500, the outer circumferential surface of the fixed gear part 200 in the non-engaged region, and the outer circumferential surface of the rotating gear part 500 in the non-engaged region.

The nozzle 800 may be disposed on at least any one of the bottom surface of the main arm 130 and the bottom surface of the auxiliary arm 150. If the nozzle 800 is disposed on the bottom surface of the main arm 130 at a position near the region of engagement between the fixed gear part 200 and the rotating gear part 500, the nozzle 800 may be capable of spraying wash water toward the region of engagement between the fixed gear part 200 and the rotating gear part 500, thereby removing the adhered foreign substances therefrom.

That is, the nozzle 800 may be capable of rapidly removing the adhered foreign substances from the region of engagement between the fixed gear part 200 and the rotating gear part 500 by spraying wash water toward the engaged region, thereby ensuring smooth revolution of the rotating gear part 500 around the fixed gear part 200.

The nozzle 800 may be disposed on the bottom surface of the auxiliary arm 150, which is connected to the portion of the main arm 130 to which the rotating gear part 500 is mounted, in order to spray wash water toward the outer circumferential surface of the rotating gear part 500.

Further, the nozzle 800 may prevent foreign substances from approaching the region of engagement between the fixed gear part 200 and the rotating gear part 500 by spraying wash water toward the outer circumferential surface of the fixed gear part 200 and the outer circumferential surface of the rotating gear part 500.

Furthermore, the nozzle 800 may prevent foreign substances from adhering to the region of engagement between the fixed gear part 200 and the rotating gear part 500 by spraying wash water toward the outer circumferential surface of the fixed gear part 200 and the outer circumferential surface of the rotating gear part 500.

Figure 14:
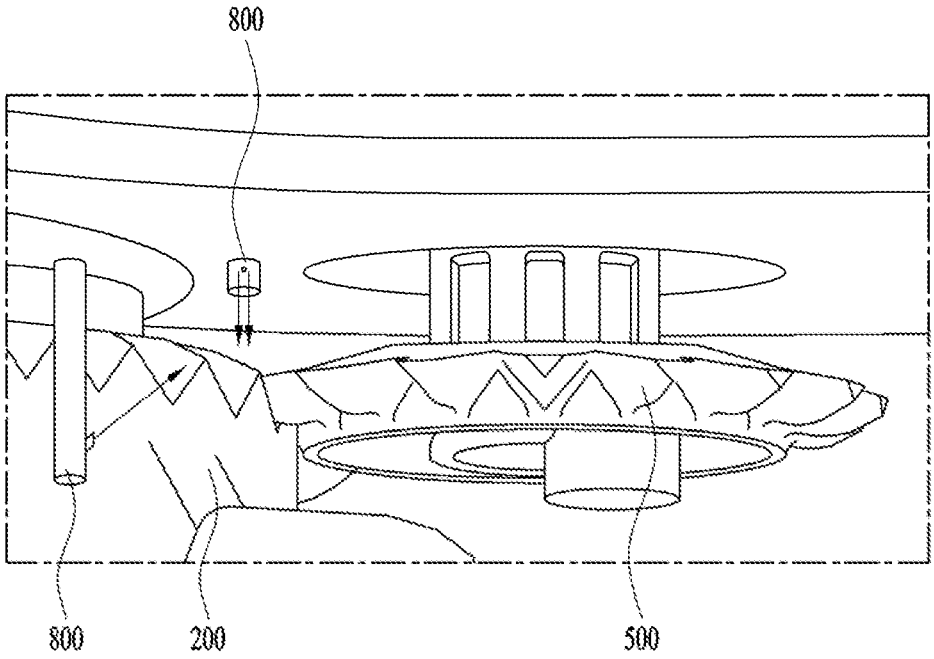
FIG. 14 is a view of an operation of an example nozzle.

FIG. 14 illustrates an example nozzle.

Referring to FIG. 14, the nozzle 800 may spray wash water at a predetermined angle relative to the plane in which the rotating gear part 500 rotates.

That is, the wash water sprayed from the nozzle 800 may be directed toward the teeth 213 of the fixed gear part 200 or the teeth 513 of the rotating gear part 500 from the region above or below the fixed gear part 200 and the rotating gear part 500 at a predetermined angle of inclination.

When the nozzle 800 sprays wash water toward the rotating gear part 500 at a predetermined angle of inclination, the adhered foreign substances may be removed from the teeth 213 and 513.

The angle between the wash water sprayed from the nozzle 800 and the plane in which the fixed gear part 200 and the rotating gear part 500 are engaged may be 90 degrees. In this case, the nozzle 800 may spray wash water in substantially the same plane as the fixed gear part 200 and the rotating gear part 500.

However, if the nozzle 800 sprays wash water in substantially the same plane as the fixed gear part 200 and the rotating gear part 500, more foreign substances may be directed toward the region between the fixed gear part 200 and the rotating gear part 500. For this reason, in some implementations, the nozzle 800 to spray wash water at a predetermined angle of inclination from above to below, or from below to above, the gear parts 200 and 500 in order to remove the adhered foreign substances from the teeth 213 and 513.

The nozzle 800 may be supplied with some of the wash water from the flow passage through which the wash water in the main arm 130 flows. However, if the nozzle 800 is supplied with wash water from the aforementioned flow passage, this may be very wasteful of wash water.

Figure 15:
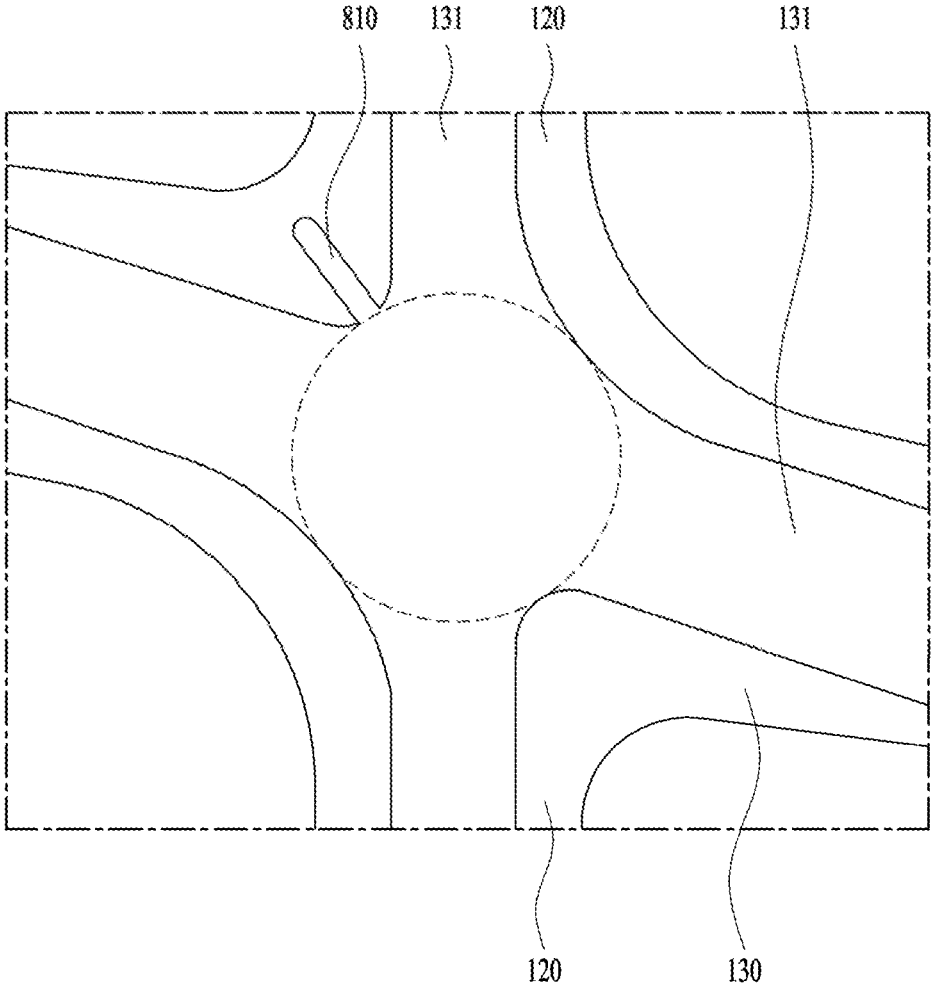
FIG. 15 is a schematic view of an example flow passage located in a spray arm.

FIG. 15 illustrates an example flow passage that is located in an example spray arm.

Referring to FIG. 15, the spray arm 100 may include a main flow passage 131, through which wash water is supplied to the main arm 130 and the extension portion 120, and a wash flow passage 810, which is branched from the main flow passage 131 and has a smaller diameter than the main flow passage 131.

The nozzle 800 may communicate with an end portion of the wash flow passage 810. Since the diameter of the wash flow passage 810 can be set to supply the water quantity and the water pressure suitable for removing foreign substances from the fixed gear part 200 and the rotating gear part 500, the consumption of wash water may be reduced.

Figure 16:
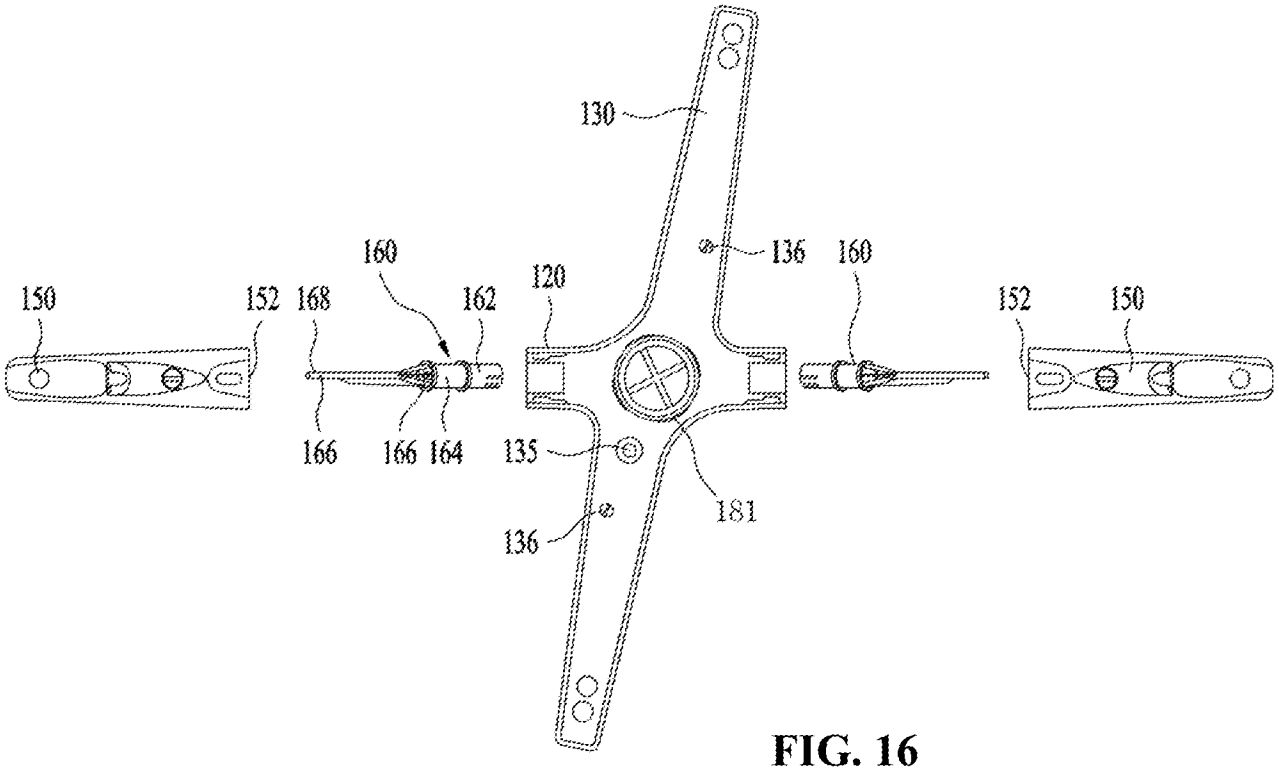
FIG. 16 is an exploded view of an example auxiliary arm connection unit.

FIG. 16 illustrates an example auxiliary arm connection unit. Referring to FIG. 16, a conventional auxiliary arm connection unit 160 may include an extension pipe 162, which is inserted into the main arm 130, a flow pipe 164, which communicates with the extension pipe 162 and through which wash water discharged from the extension pipe 162 flows, a shaft 166, which is connected to the flow pipe 164, and a projection 168, which protrudes from the shaft 166.

The shaft 166 is inserted into an auxiliary flow passage 152, which is formed in the auxiliary arm 150. The wash water discharged from the extension portion 120 flows through the auxiliary flow passage 152, and the wash water flowing through the auxiliary flow passage 152 is sprayed outside through the auxiliary spray holes 153 and 154.

The projection 168, as illustrated in the drawings, may be formed in a column shape. The auxiliary flow passage 152 may have a connection portion, which is formed around the inner circumferential surface of the auxiliary flow passage 152 and which is connected with the main arm 130 through contact with the flow pipe 164. The connection portion of the auxiliary flow passage 152 may function to support the weight of the flow pipe 164 through contact with the flow pipe 164.

In the above-described conventional structure, the wash water discharged from the main arm 130 may be supplied to the auxiliary arm 150 through the auxiliary arm connection unit 160.

However, there is a problem in that a gap may be formed in the connection portion between the main arm 130 and the auxiliary arm 150 in the event of a manufacturing error of the auxiliary arm connection unit 160. That is, a large amount of wash water may leak through the gap when it is discharged from the main arm 130.

In some implementations, wash water primarily leaks through the coupling portion between the extension pipe 162 and the main arm 130, and flows backward and secondarily leaks through the connection portion of the auxiliary flow passage 152, which connects the main arm 130 and the auxiliary arm 150.

Because wash water is not smoothly supplied to the auxiliary arm 150 due to the above-described water leakage, washing efficiency is deteriorated. This water leakage becomes more severe when the pressure of the wash water is relatively high.

Figure 17:
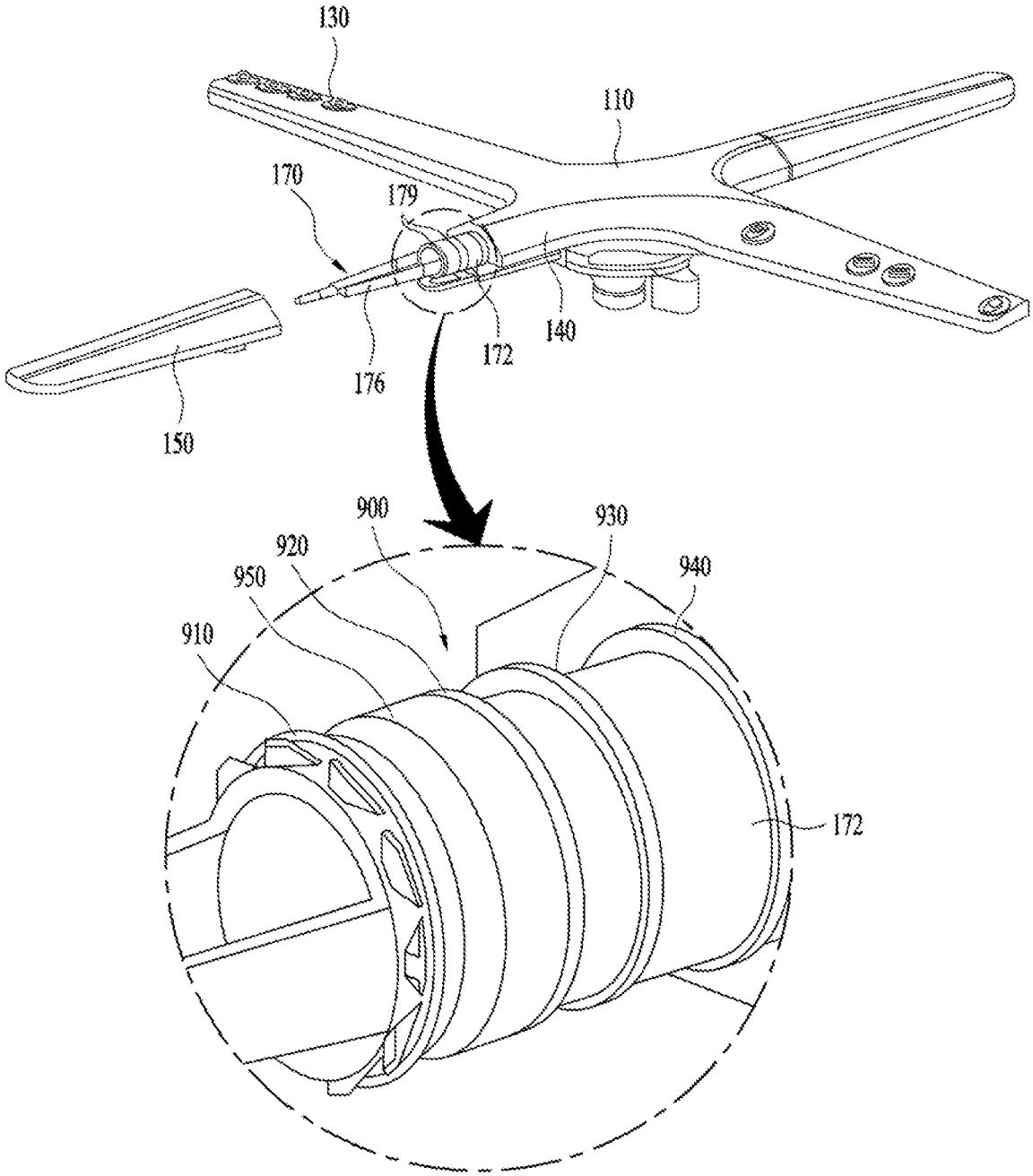
FIG. 17 is a perspective view of an example auxiliary arm connection unit.

FIG. 17 illustrates an example auxiliary arm connection unit. In order to solve the water leakage problem afflicting the conventional structure, as illustrated in FIG. 17, the auxiliary arm connection unit 170 may be formed integrally with the main arm 130.

The auxiliary arm connection unit 170 may include an extension pipe 172, which is formed integrally with the main arm 130 and extends therefrom, and a shaft 176, which extends from the extension pipe 172 and is inserted into the auxiliary flow passage 152 of the auxiliary arm 150.

The auxiliary arm connection unit 170 has the same constitution as the conventional auxiliary arm connection unit 160, except for the integral formation of the extension pipe 172 with the main arm 130. Therefore, the auxiliary arm connection unit 170 may be capable of preventing wash water from leaking between the main arm 130 and the extension pipe 172.

Further, since the main arm 130 and the auxiliary arm connection unit 170 are formed integrally with each other, it may be possible to produce these components using an injection molding method or the like. Accordingly, an additional assembly process may be obviated, which leads to an improvement in manufacturing efficiency.

Figure 18:
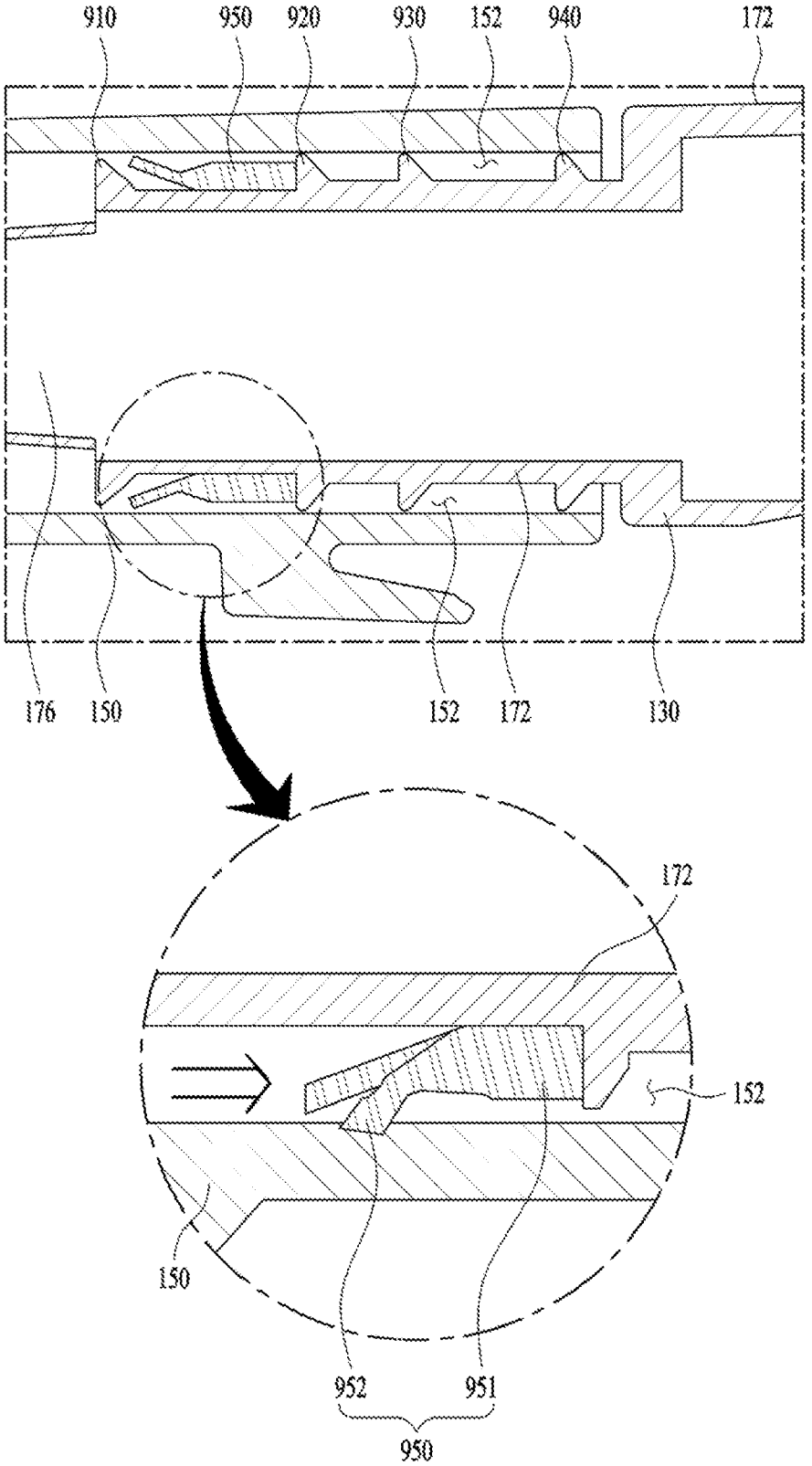
FIG. 18 is a sectional view of an example sealing unit of an auxiliary arm connection unit.

FIG. 18 illustrates an example auxiliary arm connection unit.

The structure capable of preventing wash water from leaking through the connection portion of the auxiliary flow passage 152 connecting the main arm 130 and the auxiliary arm 150 will be explained with reference to FIG. 18. A sealing unit 900 may be provided in the connection portion of the auxiliary flow passage 152 connecting the main arm 130 and the auxiliary arm 150, in order to prevent wash water from flowing backward.

The sealing unit 900 may include a plurality of first sealing members 910, 920, 930 and 940, which protrude from the outer circumferential surface of the extension pipe 172 and have a ring shape. The first sealing members 910, 920, 930, and 940 may be in contact with the inner circumferential surface of the auxiliary flow passage 152 of the auxiliary arm 150. That is, the first sealing members 910, 920, 930, and 940 may function to seal the connection portion of the auxiliary flow passage 152 connecting the main arm 130 and the auxiliary arm 150.

The first sealing members 910, 920, 930, and 940 may prevent the wash water discharged from the extension pipe 172 from leaking through the connection portion of the auxiliary flow passage 152. The sealing unit 900 may further include a second sealing member 950, which is disposed between two of the first sealing members 910, 920, 930, and 940.

One or more second sealing members 950 may be provided in a manner such that every second sealing member 950 is disposed in the respective region between two adjacent ones among the first sealing members 910, 920, 930, and 940. The second sealing member 950 may be attached on the outer circumferential surface of the extension pipe 172. The second sealing member 950 may include a body portion 951, which is secured to the extension pipe 172, and a bent portion 952, which extends from the body portion 951 and is capable of contacting the connection portion of the auxiliary flow passage 152. The second sealing member 950 may be formed of an elastic material.

The operation of the second sealing member 950 will now be explained with reference to FIG. 18. The body portion 951 of the second sealing member 950 may be secured to the extension pipe 172, and the bent portion 952 may be in a state of being separated from the connection portion of the auxiliary flow passage 152.

When a large amount of wash water is discharged from the extension pipe 172, some of the wash water flows toward the spray holes 153 and 154 in the auxiliary arm 150, and the remainder of the wash water flows backward to the connection portion of the auxiliary flow passage 152. At this time, if the pressure of the wash water is increased, the amount of wash water flowing backward to the connection portion of the auxiliary flow passage 152 is also increased.

If the wash water flows backward to the connection portion of the auxiliary flow passage 152, the backflowing wash water pressurizes the bent portion 952. Accordingly, the bent portion 952 comes into contact with the connection portion of the auxiliary flow passage 152.

If the pressure of the wash water is increased, the bent portion 952 is further pressurized toward the connection portion of the auxiliary flow passage 152. Accordingly, the second sealing member 950 may prevent wash water from leaking through the outer circumferential surface of the extension pipe 172 and the inner circumferential surface of the auxiliary flow passage 152. As a result, all of the wash water supplied to the spray arm 100 may be sprayed toward an object to be washed without leakage, thereby improving washing efficiency.

As is apparent from the above description, the subject matter described above provides a dishwasher that is capable of preventing foreign substances removed from an object to be washed from adhering to a fixed gear part and a rotating gear part.

In addition, since smooth rotation of the spray arm is ensured without the adherence of foreign substances to the fixed gear part or to the rotating gear part, the fixed gear part and the rotating gear part may be prevented from being damaged.

In addition, adhered foreign substances may be removed rapidly by spraying wash water to a region of engagement between the fixed gear part and the rotating gear part.

In addition, it may be possible to prevent foreign substances from approaching a region of engagement between the fixed gear part and the rotating gear part by spraying wash water toward the outer circumferential surface of the fixed gear part and the outer circumferential surface of the rotating gear part.

In addition, foreign substances may be removed effectively by spraying wash water from above or below the fixed gear part and the rotating gear part.

In addition, washing efficiency may be improved by ensuring the smooth rotation of the spray arm.

In addition, washing efficiency may be improved by enabling the rotating gear part to revolve smoothly along the outer circumferential surface of the fixed gear part.

In addition, it may be possible to prevent components from being damaged by preventing an excessive load from being applied to the fixed gear part or to the rotating gear part due to the presence of foreign substances In addition, it may be possible to prevent corrosion and propagation of bacteria due to the adherence of foreign substances to the fixed gear part and the rotating gear part.

What is claimed is:

1. A dishwasher comprising:

a tub that defines a compartment that is configured to receive an object;

a spray arm that includes:

a main arm that is configured to rotate, that is located in the tub, and that is configured to spray wash water toward the object, and an auxiliary arm that is coupled to the main arm, that is configured to reciprocate through a predetermined arc, and that is configured to spray wash water toward the object;

a fixed gear part that is connected to the tub, that is configured to rotatably support the main arm, and that includes teeth along an outer circumferential surface of the fixed gear part;

a rotating gear part that is connected to the main arm and that is configured to rotate and engage the teeth of the fixed gear part based on rotation of the main arm; and a link unit that is connected to the rotating gear part, the main arm, and the auxiliary arm, that is configured to move based on rotation of the rotating gear part, and that is configured to guide reciprocation of the auxiliary arm through the predetermined arc, wherein the spray arm further includes a nozzle that defines a spray hole and is configured to spray wash water toward the fixed gear part and the rotating gear part.

2. The dishwasher according to claim 1, wherein the nozzle is located on a bottom surface of the spray arm and is configured to spray wash water toward at least one of a region where an outer circumferential surface of the fixed gear part where the fixed gear part does not engage the rotating gear part, or an outer circumferential surface of the rotating gear part where the fixed gear part does not engage the rotating gear part.

3. The dishwasher according to claim 2, wherein:

the spray arm further includes one or more additional nozzles, and the nozzle and the one or more additional nozzles are configured to spray wash water toward a region where an outer circumferential surface of the fixed gear part where the fixed gear part does not engage the rotating gear part, and an outer circumferential surface of the rotating gear part where the fixed gear part does not engage the rotating gear part.

4. The dishwasher according to claim 2, wherein the nozzle is located on a bottom surface of the auxiliary arm and is configured to spray wash water toward the outer circumferential surface of the rotating gear part, the bottom surface of the auxiliary arm being connected to a portion of the main arm that is connected to the rotating gear part.

5. The dishwasher according to claim 3, wherein the nozzle has a plurality of spray holes and is configured to spray wash water toward the region where an outer circumferential surface of the fixed gear part where the fixed gear part does not engage the rotating gear part, and an outer circumferential surface of the rotating gear part where the fixed gear part does not engage the rotating gear part.

6. The dishwasher according to claim 2, wherein the nozzle is configured to spray wash water at a predetermined spray angle that aligns with a plane that is defined by the rotating gear part while engaged with the fixed gear part.

7. The dishwasher according to claim 1, wherein:

the spray arm defines a supply flow passage that is configured to guide wash water to the object, and a wash flow passage that is configured to guide, to the fixed gear part and the rotating gear part, wash water that is supplied to the supply flow passage, and the nozzle is connected to an end portion of the wash flow passage.

8. The dishwasher according to claim 1, wherein the link unit includes:

a ring-shaped rim portion that is configured to receive the fixed gear part; and a plurality of connection portions that each extend from the rim portion in a radial direction and that are each connected to the spray arm, wherein the link unit defines a recessed portion in one of the connection portions, the recessed portion being configured to receive the rotating gear part and prevent interference by the rotating gear part, and wherein the link unit further includes an insertion portion that is located in the recessed portion and that guides the rotating gear part into the link unit.

9. The dishwasher according to claim 8, wherein the main arm defines:

first spray holes that are defined by a portion of the main arm, that extend in a first direction from a center of the spray arm, and that are configured to spray wash water toward the object, and second spray holes that are defined by a portion of the main arm, that extend in a second direction opposite the first direction from the center of the spray arm, and that are configured to spray wash water toward the object, wherein the main arm includes guide protrusions that are located on a bottom surface of the main arm and that are coupled to a first group of the connection portions, and wherein the auxiliary arm defines:

third spray holes that are defined by a portion of the auxiliary arm, that extend in a third direction from the center of the spray arm, and that are configured to spray wash water toward the object, and fourth spray holes that are defined by a portion of the auxiliary arm, that extend in a fourth direction opposite the third direction from the center of the spray arm, and that are configured to spray wash water toward the object, and wherein the auxiliary arm includes a force transmission part that is located on a bottom surface of the auxiliary arm and that is coupled a second group of the connection portions that are not included in the first group.

10. The dishwasher according to claim 9, wherein an angle defined by the main arm and the auxiliary arm is a right angle or an acute angle.

11. The dishwasher according to claim 9, wherein the rim portion is configured to reciprocate between the first spray holes and the second spray holes defined in the main arm based on the rotating gear part revolving along an outer circumferential surface of the fixed gear part.

12. The dishwasher according to claim 9, wherein the force transmission part is configured to reciprocate the auxiliary arm by moving in a direction of the rim portion based on the rim portion reciprocating.

* * * * *